US005845460A

United States Patent [19]

Dahm

[11] Patent Number: 5,845,460

[45] Date of Patent: Dec. 8, 1998

[54] COMPONENT TRAY STACKER FOR AUTOMATED CHIP HANDLING SYSTEM

[75] Inventor: Tim A. Dahm, Mankato, Minn.

[73] Assignee: V-Tek Incorporated, Mankato, Minn.

[21] Appl. No.: 814,308

[22] Filed: Mar. 10, 1997

[51] Int. Cl.[6] ..... B65B 59/00

[52] U.S. Cl. ..... 53/249; 53/250; 53/251; 53/246

[58] Field of Search ..... 198/465.1, 465.2, 198/345.3, 803.01; 53/249, 250, 251, 246, 247, 539, 64, 67; 221/211; 271/4.02, 10.02

[56] References Cited

U.S. PATENT DOCUMENTS

| | | | |
|---|---|---|---|
| 3,389,531 | 6/1968 | Ehe | 53/155 |
| 3,420,037 | 1/1969 | Villemure | 53/566 |
| 4,037,388 | 7/1977 | Bastasch | 53/64 |
| 4,067,172 | 1/1978 | Paules | 53/566 |
| 4,488,633 | 12/1984 | Kampf | 198/472 |
| 4,776,146 | 10/1988 | Whitehouse | 53/58 |
| 5,193,329 | 3/1993 | Loffredo | 53/473 |
| 5,365,717 | 11/1994 | McKinlay | 53/111 |
| 5,551,210 | 9/1996 | Williamson | 53/282 |
| 5,561,970 | 10/1996 | Edie | 53/473 |
| 5,626,000 | 5/1997 | Edwards | 53/281 |
| 5,649,410 | 7/1997 | Martin | 53/474 |
| 5,675,957 | 10/1997 | Kim | 53/242 |
| 5,680,746 | 10/1997 | Hornisch | 53/475 |
| 5,706,634 | 10/1998 | Edwards | 53/475 |
| 5,720,149 | 2/1998 | Stimpfl | 53/244 |
| 5,737,902 | 4/1998 | Aylward | 53/475 |

*Primary Examiner*—Daniel B. Moon
*Assistant Examiner*—James P. Calve
*Attorney, Agent, or Firm*—Craig J. Lervick

[57] ABSTRACT

A component tray handling system is provided which is capable of handling vacuum formed plastic component trays which have very different controlled surfaces and tolerances. In these vacuum formed trays, a leading ridge is formed at a known location with respect to each of a plurality of component cavities. The present system utilizes a unique drive system which is capable of interacting with this ridge rather than interacting with the leading edge of the tray. The present system also has a dual drive characteristic wherein the component trays are quickly removed or taken away from the first drive system so as to avoid any interference by the drive system with the trays or damage to the trays. This tray handling system is designed to allow easy incorporation into any number of automated manufacturing and component handling systems.

18 Claims, 3 Drawing Sheets

COMPONENT TRAY STACKER FOR AUTOMATED CHIP HANDLING SYSTEM

BACKGROUND OF THE INVENTION

The present invention relates to a device for handling small parts and components. More specifically, the present invention relates to a device for handling parts and components in conjunction with handling trays.

It is very common in the art of microelectronics and components to place piece parts in component trays which are designed for the separation and handling of such small parts. These trays have specific recesses or cavities in which parts can be easily placed. Furthermore, when parts are placed in such trays, they exist at a known location with respect to the boundaries of the trays. As is well known, the placement of such parts at known locations is very advantageous when incorporating parts into automated assembly systems.

Historically, component trays have been used which are high quality devices—designed and fabricated to meet very tight tolerances. Due to the tight control of tolerances on these component trays (i.e. the dimensions of the tray and the relationship of part cavities to tray edges), prior art component trays have been particularly well adapted for use in automated component handling systems. When used in these automated systems, the tray can be positioned in a predefined position. Once in such position, component handling devices (also known as pick and place devices) can easily move parts on to or off of the trays. For example, a component supplier could easily provide parts to a component handling device, wherein the component handling device would then place a single component within a predetermined tray cavity. In this application, a large number of component parts can be placed into these component trays in a predefined fashion at very high speeds. Furthermore, the orientation of each part can easily be controlled. Once in trays, these parts can be transmitted to further manufacturing operations and placed into devices or products.

As previously stated, prior art component trays have always had very tight tolerances between the tray edges and component cavities. Therefore, it was easy to control placement of parts into the trays when the position of the tray edges was known. However, such tightly controlled component trays are potentially expensive to fabricate and therefore inappropriate for large production applications. As one could easily understand, the use of a less expensive tray in the manufacturing process helps to reduce the overall manufacturing costs of products—especially when dealing with high volumes of products.

Another type of component tray which is used in industry is a vacuum formed plastic sheet tray with a different type of controlled tolerance. In such a modified tray, the actual edge of the tray will not have a tightly controlled tolerance; however, a predefined ridge located in close proximity to the tray edge will be precisely positioned. Stated alternatively, the positioning of this predetermined ridge will be tightly controlled in relation to the component cavities. Therefore, if positioning of the tray can be accomplished via the use of this predetermined ridge, automated component handling can more easily be achieved.

Prior art tray handling systems have traditionally allowed the trays to ride on belts or conveyors. In these conveyor systems, the tray was placed at a known location on the conveyor and its position was controlled by appropriately moving the conveyor. Positioning on the conveyor was achieved through the use of the controlled tray edges. As stated, when the trays themselves are not dimensioned such that the component cavities are closely positioned relative to the tray edges, such "edge control" does not appropriately control the position of component cavities. Therefore, these prior art systems are incapable of providing the necessary tray positioning for use in automated component handling systems.

Referring now to FIG. 1, there is shown a partial cross-sectional drawing of the two previously discussed tray configurations. The difficulties and problems with the prior art systems will more easily be understood by comparing FIGS. 1A and 1B. As shown in FIG. 1A, a component tray 10 is fabricated of fairly rigid material or plastic with a plurality of component cavities or recesses 12 contained therein. While these recesses are shown in semicircular configuration, it is understood that numerous types of recesses exist, including semicircular, rectangular, polygonal, etc. First component tray 10 has a leading edge 14 which is perpendicular to the major planar surface 16 of tray 10. The dimensions of the tray are controlled such that the location of each component cavity 12 is in a precise location relative to leading edge 14. Consequently, when this tray is used in an automated component handling system, if the location of leading edge 14 is known, so are the locations of component cavities 12. Therefore, positioning of tray 10 is accomplished by manipulating and controlling the position of leading edge 14.

Referring now to FIG. 1B, there is shown a modified component tray 20 for use with the present invention. As can be seen, modified tray 20 is made of a much thinner material which in one embodiment may include an injection molded plastic. Again, modified component tray 20 has a plurality of component cavities 12 which are essentially identical in the configuration of those shown in FIG. 1A. Again, it is understood that, while the component cavities of modified tray 20 are shown in semicircular configuration, these component cavities could easily be configured in appropriate shapes so as to accommodate the parts being handled. Modified component tray 20 has a leading edge 22 which is very different from that of first component tray 10. Modified component tray 20 also has a ridge 24 which comprises a surface perpendicular to a primary tray planar surface 26. Due to the fabrication techniques used to make the modified tray 20, it is impossible to totally control the dimensions and positioning of leading edge 22 relative to component cavities 12. However, modified tray 20 can be fabricated such that tray ridge 24 is positioned in a known relationship with component cavities 12. Furthermore, the tolerances of these dimensions can be very easily controlled to very precise levels. Therefore, when using modified tray 20 in a component handling system, it is necessary to control the position of tray ridge 24 so as to also control component cavities 12. Such control, however, is not easily achieved by prior art systems because tray lip portion 28 extends perpendicular to the surface of tray ridge 24. Dealing with tray lip 28 is particularly troublesome as this is the lowermost part of the tray which would contact any conveyors and/or belts. Therefore, use of prior component handling systems is impractical.

An additional problem with prior art component handling systems is the possibility of slippage while on the conveyor belt. When used in these conveyor systems, it is critical that the component tray does not slide or slip while on the conveyor belt. Such slippage can cause all alignment and positioning to become inaccurate. Such slippage is clearly possible; however, as these component trays must interact with other parts or systems of an overall component handling system. Therefore, it is possible for large amounts of slippage and misalignment to occur. Because of these alignment problems, these prior art conveyor systems are inefficient for use in present day automated component handling systems.

SUMMARY OF THE INVENTION

The present invention provides a component tray handling and stacking system which is capable of performing appropriate positioning and handling of the modified component trays as shown in FIG. 1B.

The present invention provides a tray stacking and handling mechanism for use in an automated component handling system. In the system, modified component trays are provided from an external mechanism to the tray handling system. The tray is then appropriately manipulated and positioned so that component parts can be placed within the plurality of component cavities of the tray by a pick and place machine. This positioning involves the use of a tray guide mechanism with a separate drive. Mounted to the drive is a drive tine which interacts with the tray at tray ridge 24. As the tine is provided in a known position, the component tray can also be manipulated to be in a predefined precise position.

The component handling device of the present invention also includes a take away device which is capable of receiving the component tray from the tray guides and drive mechanism and pulling the tray away before the tine would interfere with the tray. The take away device is then capable of carrying the component tray to a stacking location whereby numerous component trays can be stacked and manipulated and passed on to further component handling devices.

It is an object of the present invention to provide a component tray handling device which is capable of interacting with the modified trays so as to allow for precise positioning of these modified trays.

It is a further object of the present invention to provide a component tray transport mechanism which pushes the trays to a predefined location by causing a tine to interact with a controlled surface of the modified tray.

It is a further object of the present invention to provide an appropriate take away mechanism as to insure there is no interference between the modified tray and the tray drive tines.

BRIEF DESCRIPTION OF THE DRAWINGS

Further objects and advantages of the present invention will be seen by reading the following detailed description in conjunction with the drawings in which.

DETAILED DESCRIPTION OF THE INVENTION

Figure 1B:
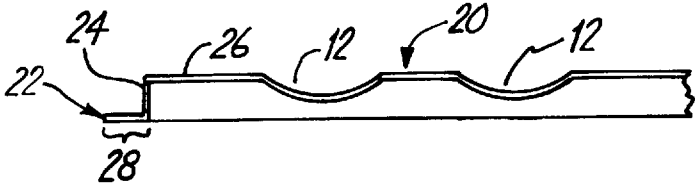
FIG. 1 is a two part drawing showing traditional component trays and the newer modified component trays.
Figure 1A:
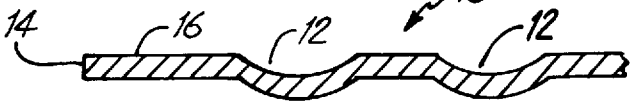
Figure 2:
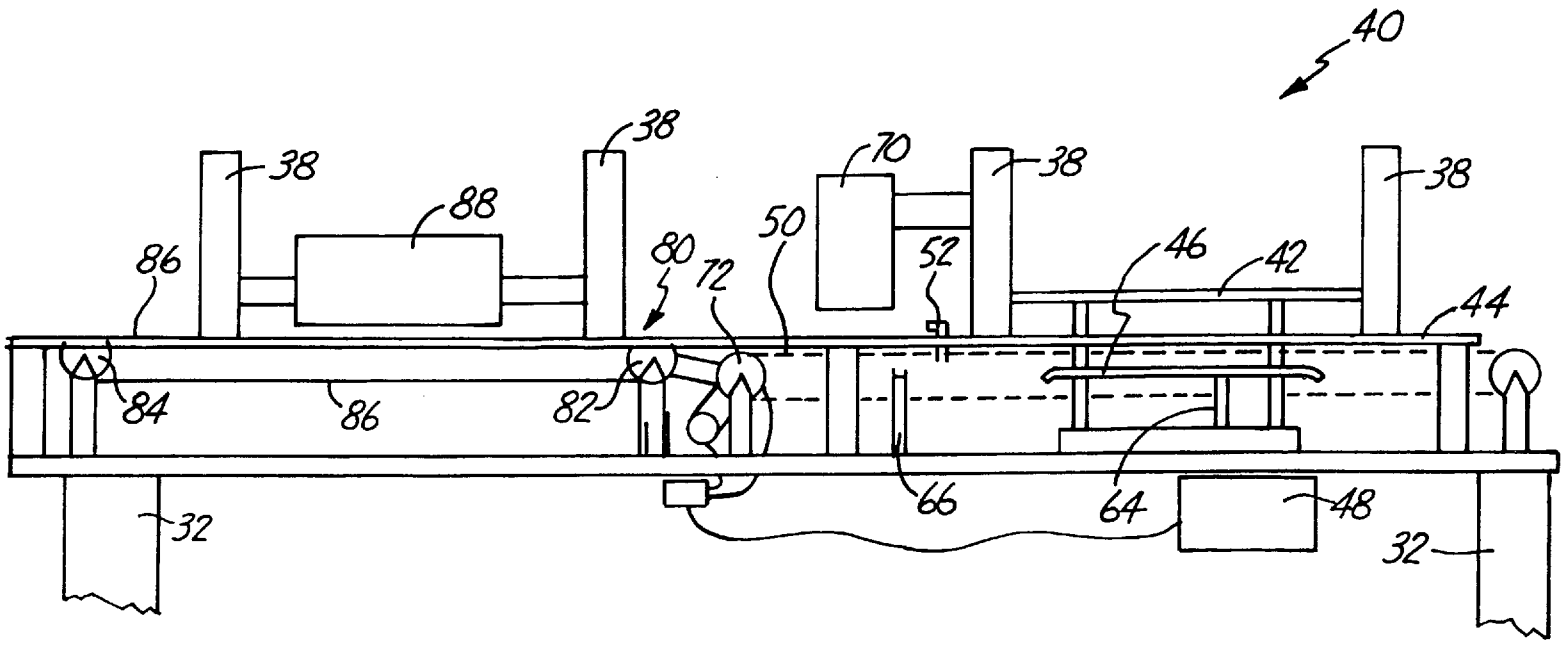
FIG. 2 is a side view of the tray stacker of the present invention.

Referring now to FIG. 2, there is shown a side view of the tray stacker system 40 of the present invention. Generally speaking, the purpose of this system is to receive component trays from a separate tray handling device and position the component trays such that a component handling device can interact with the component tray. For example, the component handling device could receive parts from a parts supply source and place those parts into the component tray in a predefined position and orientation. The result of this operation causes each part to exist in a defined orientation and position within the tray. Such parts can then be easily handled by further automated systems. Tray stacker system 40 is shown as being supported by a pair of legs 32. These could include typical table or bench legs. Alternatively, the system 40 could be supported many other ways, such as incorporated into a complex manufacturing system.

Component trays are received by tray stacker system 40 at a tray receiving elevator 42. Tray receiving elevator 42 is attached via a plurality of supports 38. Supports 38 are capable of retaining any additional mechanisms which will cooperate with tray stacker system 40. Tray receiving elevator 42 causes the component tray to be lowered on to a set of tray guides 44 via an elevator plate 46. When tray receiving elevator 42 receives the tray from an adjacent system, the tray is placed on elevator plate 46. Elevator plate 46 is shown in a lower position. To accomplish placement of the tray on tray guides 44, elevator plate 46 is simply raised to receive the tray and then lowered into a position whereby the tray interacts with tray guides 44.

Once the tray is placed on tray guides 44, a control system 48 causes chain drive 50 to be enabled. In summary, the chain drive operates to push the tray along tray guides 44 such that the tray is transported to a known location. Chain drive 50 extends along a portion tray stacker system 40. This portion specifically extends along a portion of tray stacker system 40 which requires exact positioning of the trays. This portion specifically includes the position where elevator 46 drops the tray on to tray guides 44. Attached to chain drive 50 are a plurality of tine links 52. Tine links 52 are attached to a chain 54 such that movement of chain drive 50 and chain drive 54 causes tines 52 to be transported along the length of chain drive 50.

Tine links 52 are specifically designed to appropriately interact with the modified component trays. As previously mentioned, modified component trays 20 have a controlled tray ridge 24 which has a known location in relationship to the plurality of component cavities 12 contained on modified tray 20. Consequently, by controlling the position of tray ridge 24, the position of component cavities 12 is also controlled. Furthermore, tray guides 44 contain the tray within a known alley, thereby controlling the lateral positioning of the trays.

Figure 3:
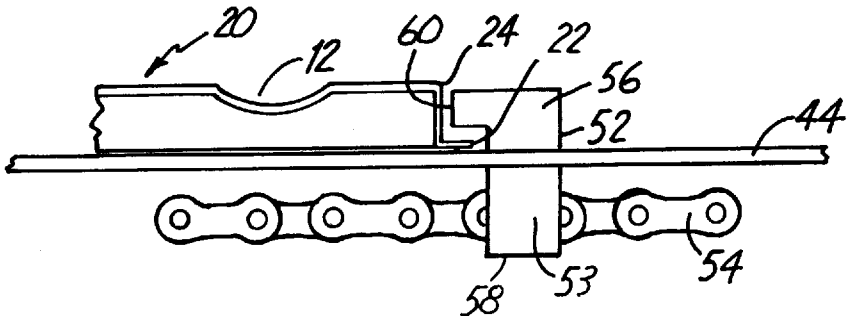
FIG. 3 is a detailed drawing showing the drive tines of the present invention and their interaction with the modified component trays.

Referring now specifically to FIG. 3, there is shown an exploded view of chain 54 and tine link 52. As can be seen, chain 54 exists at a position slightly below tray guides 44. Tine link 52 extends upwardly from chain 54 to a position which is above tray guides 44. Tine link 52 has main body portion 53 which is a substantially rectangular configuration. Tine link 52 has an extension 56 on the leading edge thereof. Extension 56 also has a substantially rectangular configuration. This extension allows tine link 54 to interact with tray ridge 24 to achieve the required known positioning. Furthermore, extension 56 allows tine link 52 to avoid any contact with modified tray leading edge 22.

Tine link 52 also has a lower portion 58 which extends below chain 54. This lower portion 58 allows tine link to interact with a plurality of sensors. By interacting with prepositioned sensors, the position of tine link 52, and specifically the position of tine extension leading edge 60, can be easily controlled.

Referring again to FIG. 2, two such position sensors, 64 and 66, are shown. First position sensor 64 is located near elevator plate 46. This sensor can detect a known position when chain drive 50, and specifically tine 52, has interacted with tray ridge 24. As the relationship between lower portion 58 and leading edge 60 are known, the position of tray ridge 24, when interacting with tine leading edge 60, is also known. Following this detection point, the tray can be transported to any location desired in a very precise manner.

In the present invention, the modified tray 20 is next transported to a position adjacent a component handling device 70. Component handling device 70 may include a pick and place device which is capable of precisely handling and positioning component parts. Such a pick and place device could be used to either retrieve parts from modified component tray 20 or to place parts in modified component tray 20.

After the necessary component handling operations have been completed, the component tray must be moved away from component handling device 70 to allow a new tray to be moved in position. Therefore, when component handling operations are complete, chain drive 50 is restarted to move the component tray away from component handling device 70. As the tray is moved along tray guides 44, tine link 52 will encounter second position sensor 66. Second position sensor 66 will indicate that the tray has been moved to the end of chain drive 50. Once moved on to this position, a second belt drive or take away drive 80 is started. Take away drive 80 is used to draw the tray away from the chain drive. It is necessary to pull the tray away from the chain drive before the tray reaches the end of the chain drive so as to avoid interference and damage to the tray by the tine. At the end of chain drive 50, tine 52 is caused to rotate around an end sprocket 72 of the chain drive. If the tray is still in tight arrangement with tine 52, such rotation will cause extension 56 to rotate over the top of the tray and press downward. Such action can cause damage to the tray or disruption of component parts placed therein. Obviously, these consequences are undesired.

Take away belt drive 80 includes a pair of end drums 82 and 84 and a typical conveyor belt 86 attached therebetween. Take away drive 80 is driven by the same motor and/or drive mechanism as chain drive 50. However, tray escape mechanism 80 is controlled through a clutched mechanism (not shown) to easily start and stop this belt drive. As modified tray 20 reaches the end of chain drive 50 and tine 52 interacts with second position sensor 66, the clutch is engaged, thus causing take away drive 80 to operate. This belt drive is geared such that it will operate at a speed higher than that of chain drive 50 therefore causing the tray mechanism to be quickly pulled away or removed from chain drive 50. Once pulled away, take away mechanism 80 causes the tray to be presented to a second tray handling device 88 for further operations. Second tray handling device 88 could include a stacking mechanism, or could include apparatus to remove the tray from this product and present it to additional automated manufacturing equipment. In the preferred embodiment, second tray handling device 88 is an elevator arrangement similar to tray receiving elevator 42.

As can be seen from the foregoing description, the present invention requires the orchestration of many different systems and apparatus. For example, two different drive mechanisms are coordinated to effectively position and move component trays in a predetermined manner. Also, tray receiving elevator 42 and second tray handling device 88 both must operate in conjunction with the chain drive 50 and take away drive 80 to appropriately position and move the component trays. Furthermore, component handling device 70 must coordinate with the drive systems of the present invention so that the tray is appropriately positioned to interact with this device. All of these operations are handled by controller 48 which interacts and coordinates all of these operations. Controller 48 clearly requires the use of first position sensor 64 and second position sensor 66 while also utilizing many inputs and control lines from the various devices shown in FIG. 2. Controller 48 could be any appropriate process control device, including a dedicated control processor, or a multipurpose computer system. Furthermore, controller 48 may communicate with other external devices to coordinate the operation of tray stacker system 40 with other automated devices.

Having illustrated and described the principles of the invention in the preferred embodiment, it should be apparent to those skilled in the art that the invention can be modified in arrangement and detail without departing from such principles. We claim all modifications coming within the scope and spirit of the following claims.

It is claimed:

1. A component tray handling device for use in placing component parts in the component tray and transporting the tray to a desired location wherein the tray has a vertical controlled ridge substantially perpendicular to a horizontal tray lip, comprising:

a first tray transport having a tray drive including a plurality of tines for interacting with the tray at a defined location, wherein the first tray transport causes the tray to be pushed by the tines, each of the plurality of tines include a substantially rectangular main body portion and an integral perpendicular extension extending from a surface of the main body portion at an upper end of the main body portion such that the extension overlaps without contacting said tray lip and is capable of only interacting with said vertical tray controlled ridge, thereby preventing said tray lip from contacting any portion of said tines;

sensing means for determining the position of the tray on the first tray transport;

controlling means attached to the sensing means and the first tray transport for receiving signals indicative of the tray position and providing signals to the first tray transport which will cause the tray transport to position the tray at a predetermined location; and a second tray transport adjacent the first tray transport for receiving the tray and moving it to a stacking position.

2. The component tray handling device of claim 1 wherein the first tray transport operates at a first intermittent speed and the second tray transport operates at a second intermittent speed, and wherein the second intermittent speed is greater than the first intermittent speed.

3. The component tray handling device of claim 1 wherein the first tray transport includes a chain drive having the plurality of tines attached thereto.

4. The component tray handling device of claim 1 further comprising a component handling device which operates in cooperation with the first tray transport to place the component parts at predetermined locations on the component tray.

5. The component tray handling device of claim 1 wherein the second transport device is a belt drive.

6. The component tray handling device of claim 3 wherein the first tray transport further comprises a pair of tray guides which contain the trays in a predetermined lateral position with respect to the chain drive.

7. The component tray handling device of claim 1 wherein the sensing means comprise a first sensor positioned adjacent the tray receiving means and a second sensor, spaced from the first sensor and positioned along the tray transport between the first sensor and the second tray transport.

8. A component tray handling device for use in placing component parts in the component tray and transporting the tray to a desired location wherein the tray has a vertical controlled ridge substantially perpendicular to a horizontal tray lip, comprising:

a first tray transport having a tray drive;

a plurality of tines connected to the tray drive, wherein the plurality of tines each comprise a substantially L-shaped member having a main body and an integral perpendicular extension terminating in a leading edge;

a tray supply located adjacent the first tray transport for supplying a plurality of trays to the tray transport, wherein when trays are moved along the tray transport by the integral perpendicular extension substantially overlapping without contacting the tray lip so that the leading edge of the extension contacts solely the controlled ridge;

sensing means for determining a position of the tray on the first tray transport;

controlling means interconnected with the sensing means for controlling a position of the tray;

component handling means located adjacent the first tray transport for moving components between a storage location and placement on the tray;

a second tray transport located adjacent to the first tray transport, for receiving the tray from the first tray transport after the tray has passed the component handling means and moving the tray to a predetermined location, wherein the intermittent speed of movement of the second tray transport is greater than the intermittent speed of movement of the first tray transport.

9. The component tray handling device of claim 8 wherein, the second tray transport is only caused to move by the controlling means when the sensing means detects that the tray has passed the component handling means.

10. The component tray handling device of claim 9, wherein the sensing means comprise a first sensor positioned adjacent the tray supply and a second sensor, spaced from the first sensor and subsequent to the component handling means.

11. The component tray handling device of claim 8 wherein the first tray transport includes a chain drive having the plurality of tines attached thereto.

12. The component tray handling device of claim 8 wherein the second transport device is a belt drive.

13. A system for handling component parts comprising:

a tray stacker;

a plurality of trays storable in the tray stacker, each of the plurality of trays including a planar surface having at least one component cavity, and a vertical controlled ridge extending substantially perpendicular from the planar surface, wherein a positional relationship between the controlled ridge and the component cavity is precisely defined, each of the plurality of trays further having a horizontal tray lip extending from and generally perpendicular to the controlled ridge, opposite the planar surface;

a first tray transport including a tray drive and a tray guide, the first tray transport located adjacent to the tray stacker, wherein the tray stacker moves the trays from a storage position to an engagement position with the first tray transport;

a plurality of tines coupled to the tray drive, wherein each of the tines comprises an elongated main body portion coupled to the tray drive and extending from the tray drive past the tray guide when the tine is in a tray moving position, and an integral elongated extension, extending from and substantially perpendicular to the main body portion, wherein a length of the extension is greater than a length of the tray lip wherein when one of the plurality of tines moves one of the trays, the extension of the tine only contacts the controlled ridge and the extension overlaps without contacting the tray lip;

a plurality of sensors positioned adjacent the first tray transport;

a controller interconnected with the plurality of sensors for controlling a position of the tray;

a component handler located adjacent the first tray transport for moving components between a storage location and placement into the component cavity;

a second tray transport located adjacent to the first tray transport, for receiving the trays from the first tray transport after the tray has passed the component handler and moving the tray to a predetermined location, wherein the intermittent speed of movement of the second tray transport is greater than the intermittent speed of movement of the first tray transport.

14. The system for handling component parts of claim 13 wherein the first tray transport includes a chain drive having the plurality of tines attached thereto.

15. The system for handling component parts of claim 13 wherein the second transport device is a belt drive.

16. The system for handling component parts of claim 13 wherein the plurality of sensors comprise a first sensor positioned adjacent the tray stacker and a second sensor, spaced from the first sensor and positioned along the tray transport between the first sensor and the second tray transport.

17. The system for handling component parts of claim 13, wherein, the second tray transport is only caused to move by the controller when the plurality of sensors detects that the tray has passed the component handler.

18. The system for handling component parts of claim 13, wherein the tray guide further comprises:

a pair of parallel rails;

the tines extending from the tray drive and between the rails;

wherein when the trays are transported along the first tray transport, the trays rest on said parallel rails.

* * * * *